US012778304B2

(12) United States Patent
Bartlett

(10) Patent No.: US 12,778,304 B2
(45) Date of Patent: Nov. 3, 2026

(54) HEAD BEDPOST WITH ROTATABLE STORAGE

(71) Applicant: Bart Alan Bartlett, Chatham (CA)

(72) Inventor: Bart Alan Bartlett, Chatham (CA)

( * ) Notice: Subject to any disclaimer, the term of this patent is extended or adjusted under 35 U.S.C. 154(b) by 0 days.

(21) Appl. No.: 18/667,696

(22) Filed: May 17, 2024

(65) Prior Publication Data

US 2025/0351969 A1 Nov. 20, 2025

(51) Int. Cl.
*A47C 17/62* (2006.01)
*A47C 17/86* (2006.01)

(52) U.S. Cl.
CPC ..... *A47C 17/62* (2013.01); *A47C 17/86* (2013.01)

(58) Field of Classification Search
CPC ..... A47C 19/022; A47C 19/22; A47C 15/002; A47C 21/003; A47C 17/62; A47C 17/86; A47C 17/52; A47C 17/58; A47C 19/005; A47C 20/027; A47C 19/021; A47B 85/00; A47D 11/005; A47D 13/063; A47D 5/00; A61G 7/0506; F16B 12/54
USPC ..... 5/308, 53.1, 2.1, 110, 503.1, 52, 634, 5/131, 183, 285, 53.2, 58, 6
See application file for complete search history.

(56) References Cited

U.S. PATENT DOCUMENTS

| | | | | |
|---|---|---|---|---|
| 100,663 | A * | 3/1870 | Pierce | A47C 19/22 5/2.1 |
| 3,419,921 | A * | 1/1969 | Flood | A47C 19/22 5/52 |
| 2003/0159214 | A1* | 8/2003 | Kurtz | A47C 17/86 5/503.1 |
| 2021/0076832 | A1* | 3/2021 | Gwee | A47C 19/024 |

* cited by examiner

*Primary Examiner* — Madison Matthews
(74) *Attorney, Agent, or Firm* — Capehart Law Firm

(57) ABSTRACT

A head bedpost with rotatable storage is disclosed herein. The head bedpost with rotatable storage includes a rotatable storage structure, such as a shelving unit, and one or more fasteners including a hinge for attaching the rotatable storage structure to a head bedpost. The rotatable storage structure is able to be rotated relative to the head bedpost, enabling easy access to items for a user of the bed and minimizing bedside space needed for storage and display of items. The rotatable storage structure is able to be installed to existing bedposts, such as on existing bed frames or headboards; or is integral to a bed frame and/or a headboard.

19 Claims, 7 Drawing Sheets

HEAD BEDPOST WITH ROTATABLE STORAGE

BACKGROUND OF THE INVENTION

The following includes information that may be useful in understanding the present disclosure. It is not an admission that any of the information provided herein is prior art nor material to the presently described or claimed inventions, nor that any publication or document that is specifically or implicitly referenced is prior art.

The present invention relates generally to the field of bedside furniture of existing art and more specifically relates to rotatable storage structures for head bedposts.

Bedside storage plays a crucial role in enhancing the functionality and aesthetic appeal of a bedroom. Furniture pieces like nightstands, bedside tables, and cabinets serve as practical solutions for organizing essentials within arm's reach, while also contributing to the overall décor scheme. These versatile furniture pieces not only offer a convenient spot to place items such as books, lamps, or alarm clocks but also provide ample space for storing personal belongings discreetly.

However, for some individuals, space constraints or room layout may pose challenges when it comes to incorporating bedside storage solutions. In smaller bedrooms or shared living spaces, bulky furniture pieces like nightstands or cabinets might not be feasible due to limited floor space. Additionally, the placement of the bed in relation to the room's layout can affect accessibility to bedside items.

Reaching for essentials like books, glasses, or electronic devices can be inconvenient and disruptive, requiring individuals to get out of bed or stretch uncomfortably to access items placed further away. This lack of accessible storage not only hampers convenience but also disrupts the relaxation and comfort typically associated with the bedroom environment. Accordingly, a suitable solution is desired.

SUMMARY OF THE INVENTION

In view of the foregoing disadvantages inherent in the known bedside furniture art, the present disclosure provides a novel head bedpost with rotatable storage. The general purpose of the present disclosure, which will be described subsequently in greater detail, is to provide a storage structure, such as a shelving cabinet, able to be attached to a bedpost and rotated relative to the bedpost. Thereby, the storage structure enables easy access to items for a user of the bed and minimizes bedside space needed for storage and display of the items.

A rotatable storage structure for attachment to a bed frame is disclosed herein. According to some embodiments, the rotatable storage structure may include a housing and at least one fastener. The housing may include a top opposite a bottom, a front opposite a rear, and a pair of sides all defining an interior for receiving items accessible from the front. The at least one fastener may be attached to one of the pair of sides and may include a hinge having a cylindrical body comprising a central elongated opening extending from a top of the hinge to a bottom of the hinge.

The hinge may be configured to receive a bedpost of the bed frame therein, thereby attaching the housing to the bedpost. As such, the housing may be able to rotate between a first position and a second position via the hinge. The first position may include a width of the housing being generally parallel to a length of the bed; and the second position may include the width of the housing being generally perpendicular to the length of the bed frame.

According to another embodiment, a headboard with rotatable storage structure is also disclosed herein. According to some embodiments, the headboard with rotatable storage structure may include a headboard for attachment at a head end of a bed frame and including a first bedpost at a first side of the headboard and a second bedpost at a second side of the headboard. A first rotatable storage structure may be configured to attach to the first bedpost, and a second rotatable storage structure may be configured to attach to the second bedpost. The first and second rotatable storage structures may each include the features of the rotatable storage structure described above.

According to still another embodiment, a bed with rotatable storage structure is also disclosed herein. According to some embodiments, the bed with rotatable storage structure may include a bed frame and a pair of portable storage structures as discussed above. The bed frame may include a mattress frame, at least one support section attached to and extending downwardly from the mattress frame to support the bed frame on a surface, a first bedpost at a first side of a head end of the bed frame and a second bedpost at a second side of the head end of the bed frame. As discussed above, the pair of rotatable storage structures may comprise a first rotatable storage structure configured to attach to the first bedpost, and a second rotatable storage structure configured to attach to the second bedpost.

For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF FIGURES

The figures which accompany the written portion of this specification illustrate embodiments of the present disclosure, a head bedpost with rotatable storage, constructed and operative according to the teachings of the present disclosure.

The various embodiments of the present invention will hereinafter be described in conjunction with the appended drawings, wherein like designations denote like elements.

DETAILED DESCRIPTION

As discussed above, embodiments of the present disclosure relate to a rotatable storage structure. Generally, a bed with movable racks/cabinets is disclosed herein. Particularly, two rack/cabinets may be located on each side of the bed at the head bedposts (one on each side) and each is able to be rotated around the head bedpost it is attached to.

Referring now more specifically to the drawings by numerals of reference, there is shown in FIGS. 1-9, various views of a rotatable storage structure 100, or more particularly, a pair of rotatable storage structures 100. In some embodiments, the rotatable storage structure 100 may be provided for installation to any existing headboard, bedposts or bed frames aftermarket; in other embodiments, the rotatable storage structure 100 may be integral to, or pre-installed as part of a bed frame; and in other embodiments, the rotatable storage structure 100 may be integral to a headboard for installation to an existing bed frame.

Figure 1:
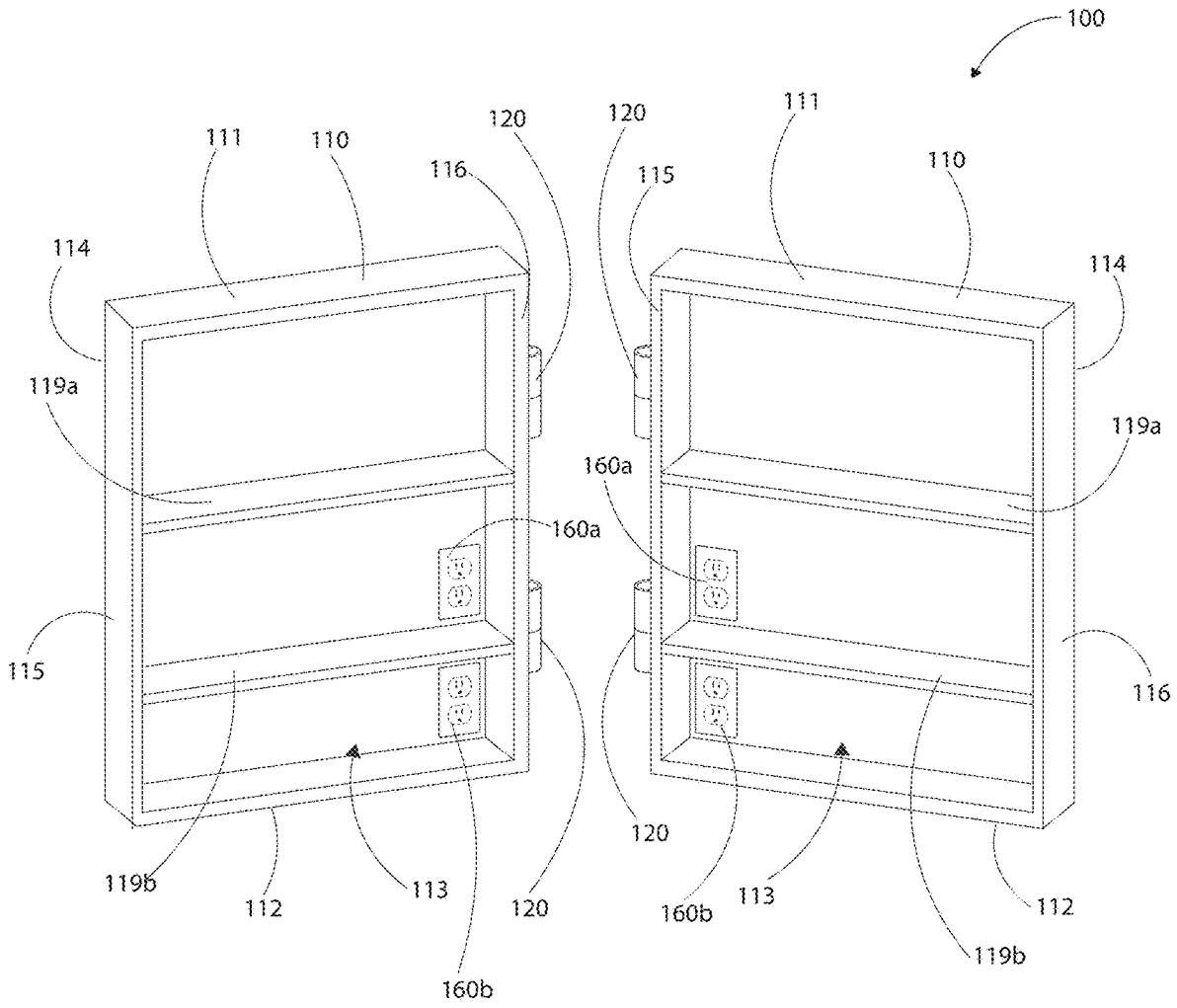
FIG. 1 is a perspective view of a pair of rotatable storage structures, according to an embodiment of the disclosure.
Figure 2:
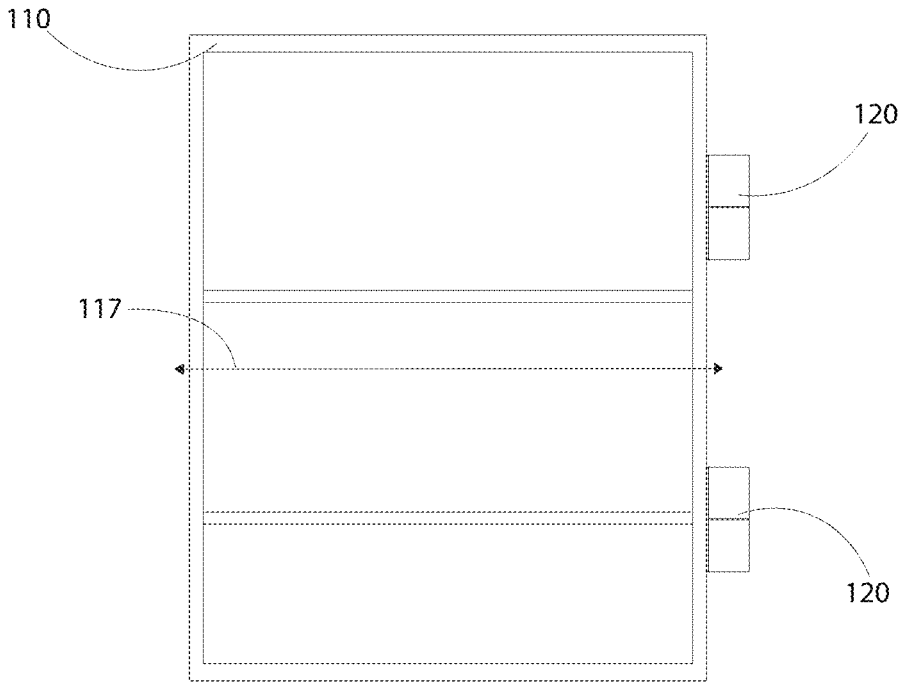
FIG. 2 is a front view of a rotatable storage structure including a housing and a pair of fasteners, according to an embodiment of the present disclosure.
Figure 3:
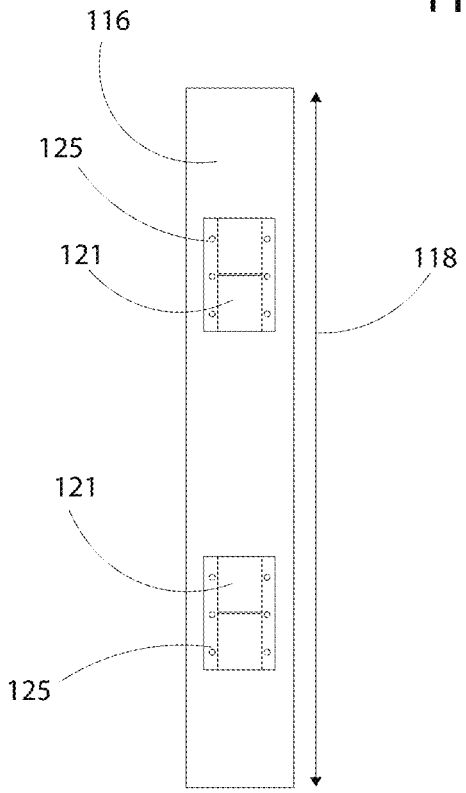
FIG. 3 is a first side view of the rotatable storage structure including the pair of fasteners, according to an embodiment of the present disclosure.
Figure 4:
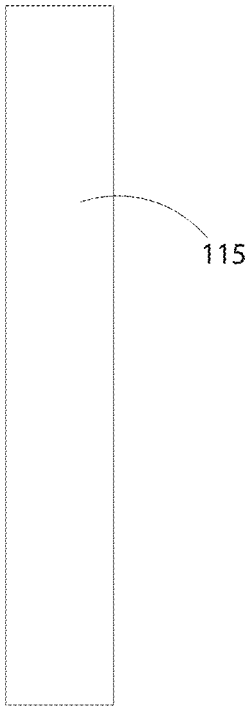
FIG. 4 is a second side view of the rotatable storage structure, according to an embodiment of the present disclosure.

Referring first to FIGS. 1-6, there are shown various views of the rotatable storage structure 100, according to one or more embodiments of the present disclosure. As shown here, the rotatable storage structure 100 may include a housing 110 having a top 111 opposite a bottom 112, a front 113 opposite a rear 114 and a pair of sides 115, 116 all defining an interior for receiving items accessible from the front 113. In some embodiments, as shown here, the housing 110 may include a rectangular cross-section. As shown in FIGS. 2-3, the housing 110 may include a width 117 parallel to the top 111 and bottom 112 of the housing 110 and a length 118 parallel to the pair of sides 115, 116 of the housing 110.

Further, in some embodiments, the housing 110 may include a plurality of shelves 119 disposed within the interior of the housing 110 for storing and displaying the items therein. For example, the plurality of shelves 119 may include (but are not limited to) three shelves 119. In some embodiments, the shelves 119 may be equally spaced apart within the interior.

In other embodiments, the shelves 119 may include varying spaces therebetween. For example, there may be a larger space between the top 111 of the housing 110 and a top shelf 119 *a* of the plurality of shelves 119, than a space between a bottom shelf 119 *b* and the bottom 112 of the housing 110, thereby enabling taller items to be placed on the top shelf 119 *a*. In some embodiments, the shelves 119 may be removable to enable adjustment of the space between the shelves 119.

As shown in FIG. 1, in some embodiments, the housing 110 may further include at least one electrical outlet disposed at, in some examples, the rear 114 of the housing. For example, as shown here, the housing 110 may include two electrical outlets 160 *a*, 160 *b*. One of the electrical outlets 160 *a* may be disposed between the top shelf 119 *a* and the bottom shelf 119 *b*, and the other electrical outlet 160 *b* may be disposed between the bottom shelf 119 *b* and the bottom 112 of the housing 110. It should however be appreciated that the electrical outlet(s) 160 *a*, 160 *b* are not limited to the particular placement discussed and shown here, nor is the rotatable storage structure 100 limited to including the electrical outlet(s) 160 *a*, 160 *b*.

As shown in these figures, the front 113 of the housing 110 may be open, exposing the interior of the housing 110, enabling easy access to items therefrom and enabling display of the items. It should however be appreciated that the front 113 of the housing 110 is not limited to being open. It should also be appreciated that the housing 110 is not limited to including shelves 119. For example, the housing 110 may include (but is not limited to) a cabinet, a set of drawers, etc.

Figure 5:
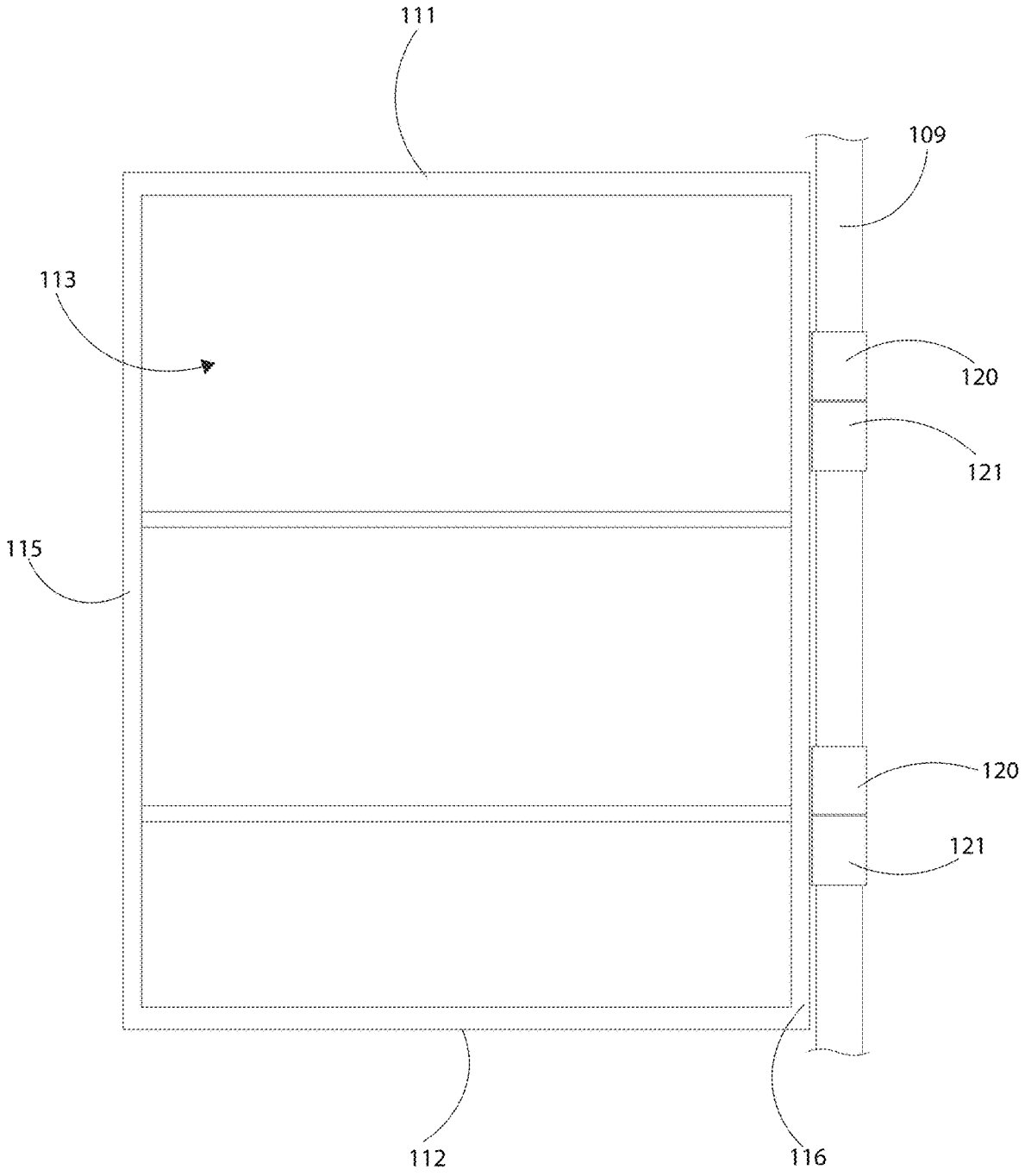
FIG. 5 is a front view of the rotatable storage structure attached to a bedpost, according to an embodiment of the present disclosure.

At least one fastener 120 may be attached to one of the pair of sides 115, 116 of the housing 110 and configured to attach the housing 110 to the bedpost 109, as shown in FIG. 5. As shown in FIGS. 1-6, two fasteners 120 may be provided on the housing 110. For example, one of the two fasteners 120 may be located toward, or nearer to, the top 111 of the housing 110 and another one of the two fasteners 120 may be located toward, or nearer to, the bottom 112 of the housing 110.

Further, as also shown here, the at least one fastener 120 may include a hinge 121 having a cylindrical body comprising a central elongated opening 122 extending from a top of the hinge 121 to a bottom of the hinge 121 and configured to receive a bedpost 109 (of a headboard or bed frame) therein, thereby attaching the housing 110 to the bedpost 109. In some embodiments, the hinge 121 may fully circumscribe the bedpost 109 to secure it therein.

As above, the rotatable storage structure(s) 100 may, in some embodiments, be configured to attach to any existing bedpost 109. As such, in some embodiments the fastener 120 may comprise a means of enabling attachment to the bedpost 109. For example, the fastener 120 may 'snap' onto the bedpost 109, may slide onto the bedpost 109, may clamp onto the bedpost 109, etc.

Figure 6:
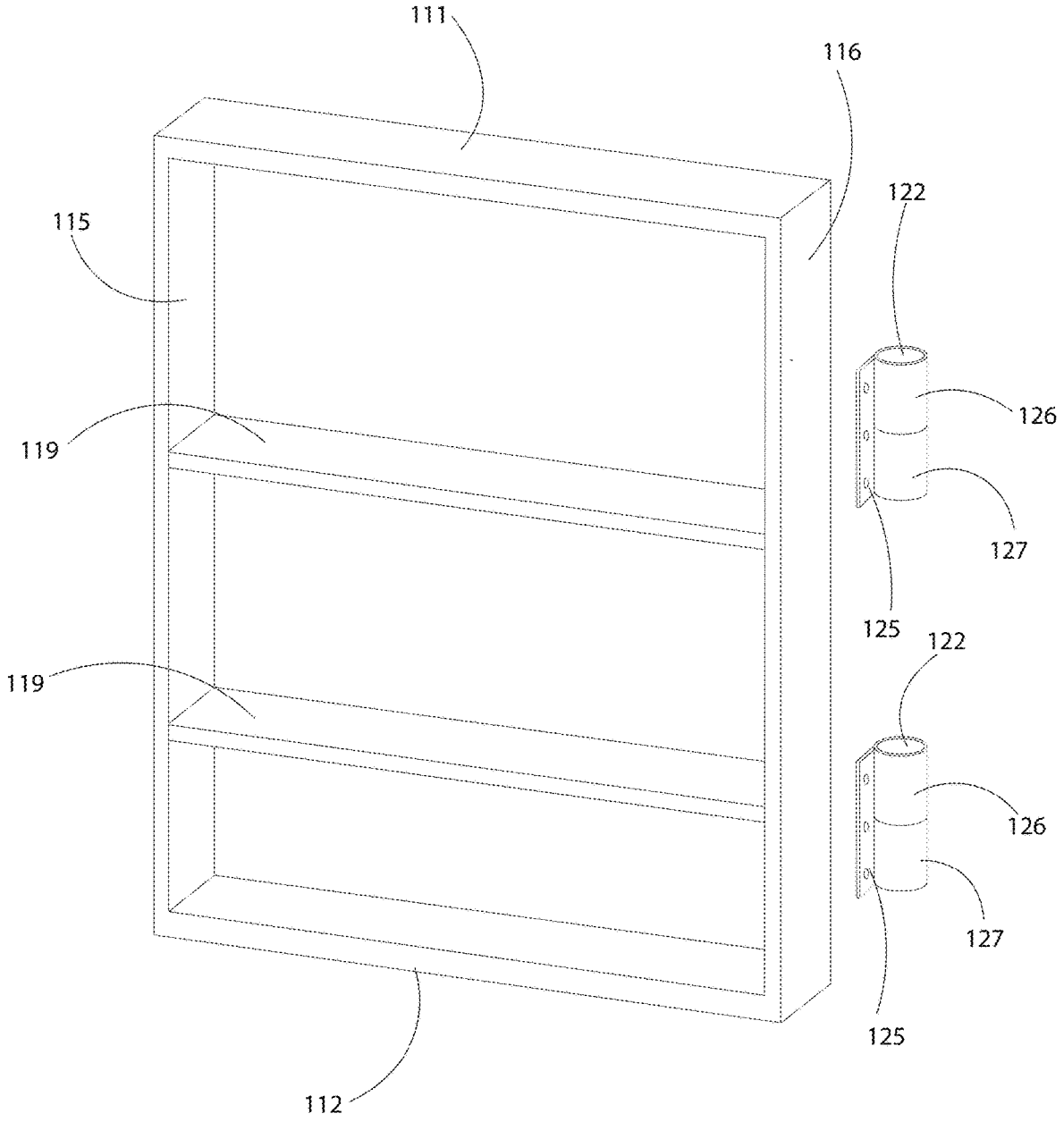
FIG. 6 is a partial exploded view of the rotatable storage structure including the housing and the pair of fasteners, the pair of fasteners having a cylindrical hinge, according to an embodiment of the present disclosure.

As shown particularly in FIG. 6, the hinge 121 may be a barrel-type hinge being substantially hollow to accept the bedpost 109 (FIG. 5) therein. The at least one fastener 120 may further include a bracket 125 to which the hinge 121 is attached and the bracket 125 may be configured to attach to the one of the pair of sides 115, 116 of the housing 110. For example, the bracket 125 may be screwed or bolted into the one of the pair of sides 115, 116 of the housing 110.

As shown here, the hinge 121 may include a first portion 126 that is secured to the bedpost 109 and prevented from rotational movement; and a second portion 127 that is able to rotate relative to the first portion 127 and cause rotational movement of the housing 110. It should however be appreciated that this means of rotational movement is provided as an example and the hinge 121 is not limited to this configuration.

Figure 7:
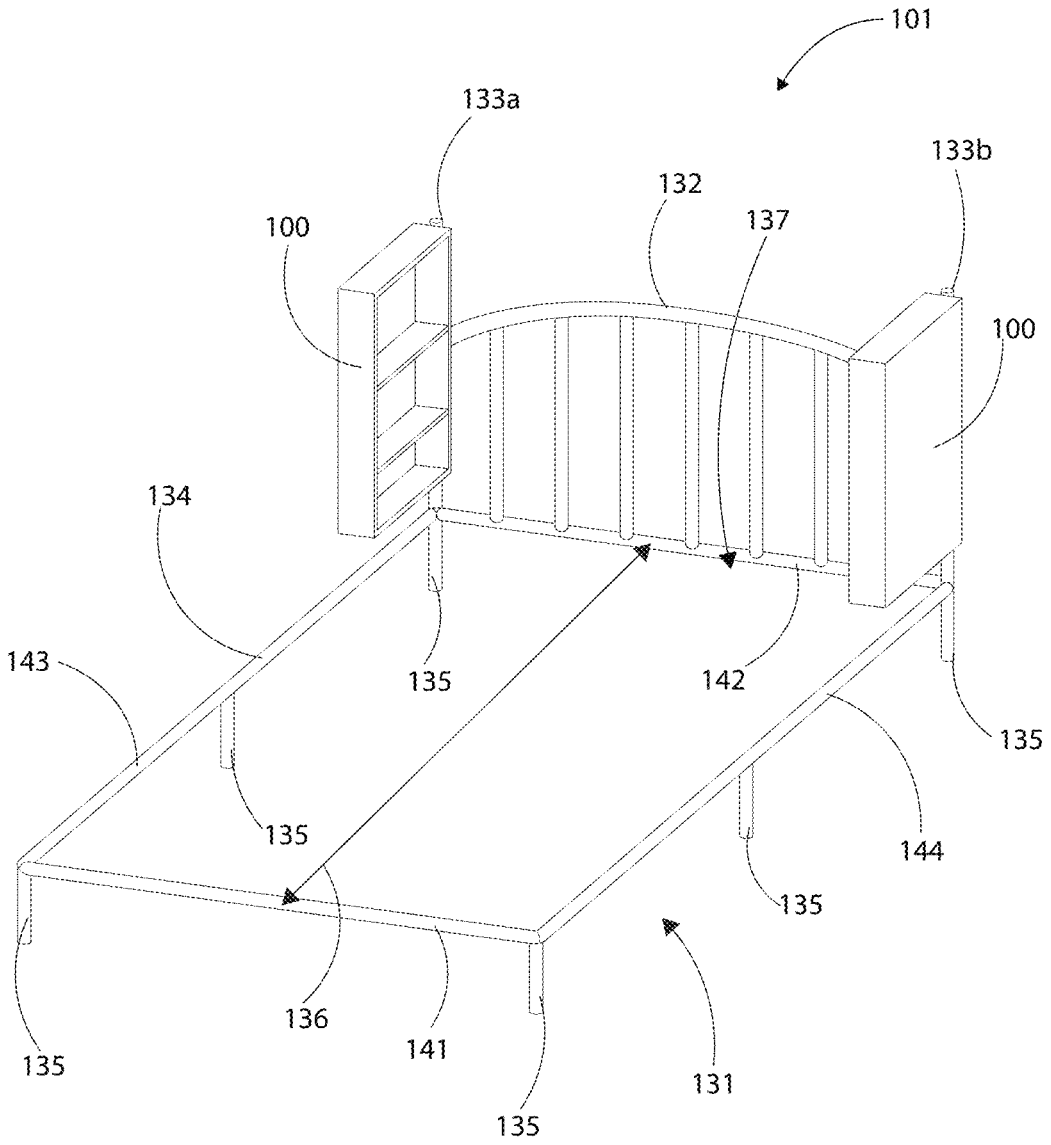
FIG. 7 is a front perspective view of the pair of rotatable storage structures attached to a bed frame and in a first position, according to an embodiment of the present disclosure.
Figure 8:
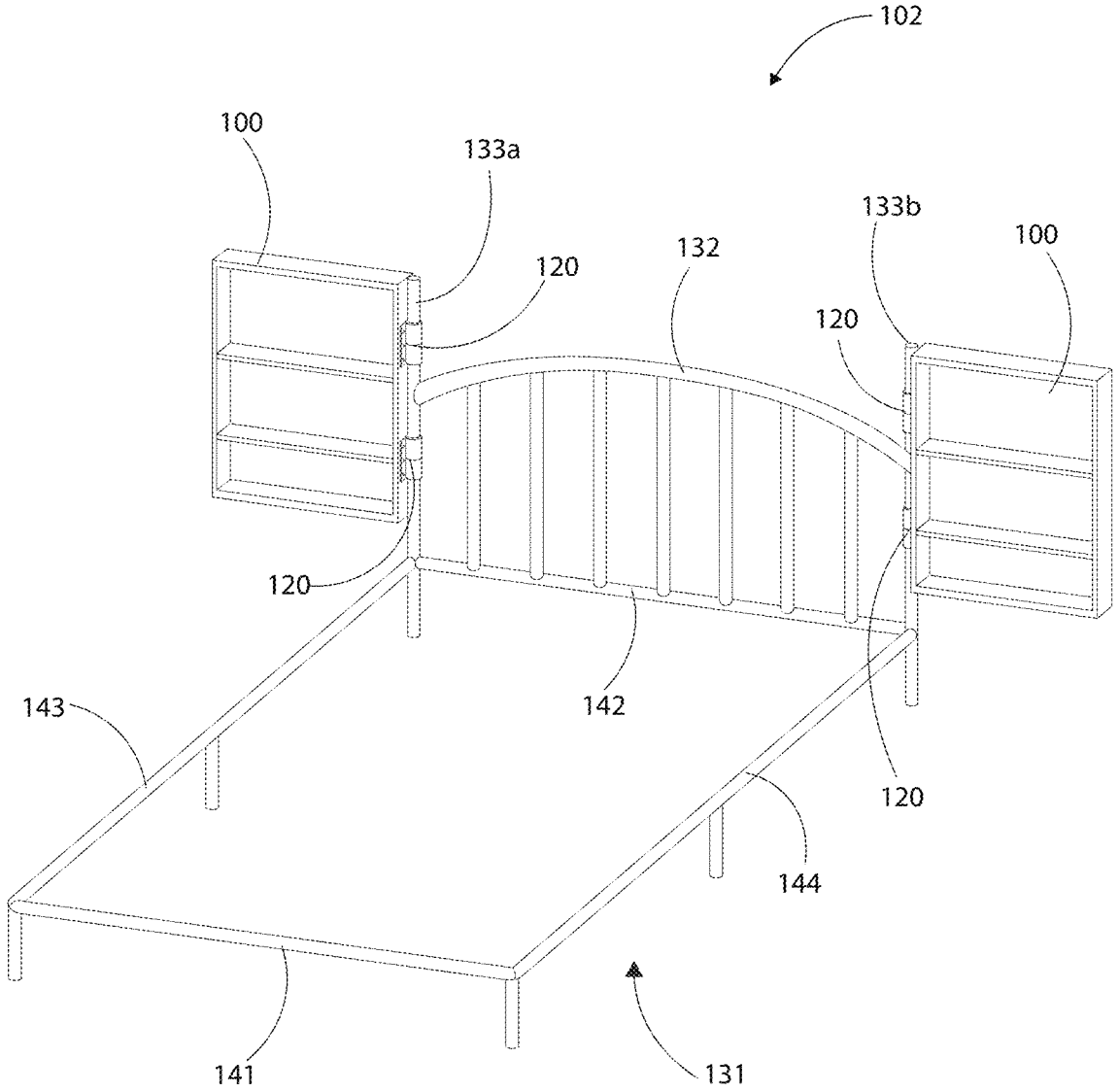
FIG. 8 is a front perspective view of the pair of rotatable storage structures attached to the bed frame and in a second position, according to an embodiment of the present disclosure.
Figure 9:
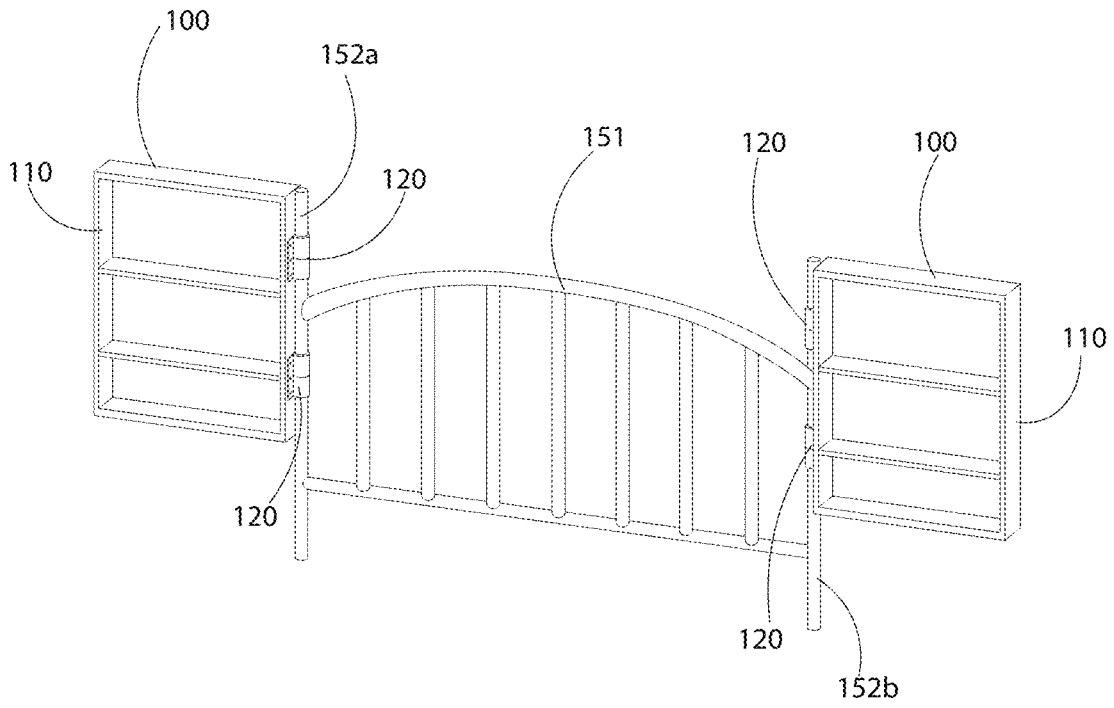
FIG. 9 is a front perspective view of the pair of rotatable storage structures attached to a headboard, according to an embodiment of the present disclosure.

Referring now also to FIGS. 7-9, illustrating front perspective views of the rotatable storage structure 100, and more particularly, a pair of rotatable storage structures 100, attached to a bedpost 133 of a bed frame 131. As above, in some embodiments, the rotatable storage structure 100 may be provided for installation to any existing headboard, bedpost or bed frames aftermarket; in other embodiments, the rotatable storage structure 100 may be integral to, or pre-installed as part of a bed frame 131, as shown in FIGS. 7-8; and in other embodiments, the rotatable storage structure 100 may be integral to a headboard 151 for installation to an existing bed frame, as shown in FIG. 9.

As shown most particularly in FIGS. 7-8, the housing 110 may be able to rotate between a first position 101 and a second position 102 via the hinge 121. Particularly, the rotation of the second portion 127 relative to the first portion 126 enables the rotation of the housing 110 between the first position 101 and the second position 102. As shown in FIG. 7, the first position 101 may include a width 117 (FIG. 2) of the housing 110 being generally parallel to a length 136 of the bed frame 131. As shown in FIG. 8, the second position 102 may include the width 117 (FIG. 2) of the housing 110 being generally perpendicular to the length 136 of the bed frame 131.

As shown in FIG. 7, the first position 101 includes the front 113 of the housing 110 facing inward toward the bed frame 131, such that a user on the bed is able to view the front 113 of the housing 110 and easily retrieve the items therein. In the first position 101, the rotatable storage structures 100 also enclose a head end 137 of the bed frame 131, which may provide comfort to the user of the bed, block light, etc. As shown in FIG. 8, the second position 102 includes the front 113 of the housing 110 facing frontward, such that a user viewing the bed frame 131 front on is able to view the front 113 of the housing 110 and retrieve the items therein.

As further shown in FIGS. 7-8, the bed frame 131 may include a mattress frame 134 configured to receive a mattress. For example, as shown here, the mattress frame 134 may include a rectangular configuration having rounded corners and consisting of a front bar 141 defining a foot end of the bed frame 131, a rear bar 142 defining a head end 137 of the bed frame 131 and a pair of side bars 143, 144 therebetween forming a left and right side of the bed frame 131.

At least one support section may be attached to and extending downwardly from the mattress frame 134 to support the bed frame 131 on a floor. For example, as shown here, the at least one support section may include a plurality of legs 135. The plurality of legs 135 may include (but are not limited to) a total of six legs 135, with a leg 135 located at each corner of the mattress frame 134, and another two legs 135 each located at a central location on the pair of side bars 143, 144, totaling three legs 135 per side of the bed frame 131. It should be appreciated that the invention is not limited to this particular number of legs 135, nor is the invention limited to including legs 135.

As shown here, the bed frame 131 may include a first bedpost 133 *a* at a first side of the head end 137 of the bed frame 131; and a second bedpost 133 *b* at a second side of the head end 137 of the bed frame 131. In some embodiments, the bedposts 133 *a*, 133 *b* may be integral to a headboard 132 of the bed frame 131. As shown in FIGS. 7-8, the headboard 132 is attached to, or attachable to, the head end 137 of the bed frame 131.

In other embodiments, as discussed above and shown in FIG. 9, a headboard 151 may be provided separately and configured for attachment to an existing bed frame. In this embodiment, a first bedpost 152 *a* may be attached to a first side of the headboard 151 and a second bedpost 152 *b* may be attached to a second side of the headboard 151.

It should be appreciated that the bed frame, the bedposts and/or the headboard illustrated in FIGS. 7-9 and discussed here are provided as examples only and are not meant to the limit the present invention in any way.

It should also be noted that, under appropriate circumstances, considering such issues as design preference, user preferences, marketing preferences, cost, structural requirements, available materials, technological advances, etc., other structural elements are method of use are taught herein.

It should be understood by one of skill in the art that the disclosed invention is described here in a few exemplary embodiments of many. No particular terminology or description should be considered limiting on the disclosure or the scope of any claims issuing therefrom.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the relevant patent offices and the public generally, and especially the scientist, engineers and practitioners in the art who are not familiar with patent or legal terms or phraseology, to determine quickly from a cursory inspection the nature and essence of the technical disclosure of the application.

The invention claimed is:

1. A rotatable storage structure for attachment to a bed frame, the rotatable storage structure comprising:

a housing including a top opposite a bottom, a front opposite a rear and a pair of sides all defining an interior for receiving items accessible from the front; and at least one fastener attached to one of the pair of sides, the at least one fastener including a hinge having a cylindrical body comprising a central elongated opening extending from a top of the hinge to a bottom of the hinge and configured to receive a bedpost of the bed frame therein, thereby attaching the housing to the bedpost; and wherein the housing is able to rotate between a first position and a second position via the hinge, the first position including a width of the housing being generally parallel to a length of the bed frame, and the second position including the width of the housing being generally perpendicular the length of the bed frame, and wherein the hinge fully circumscribes the bedpost.

2. The rotatable storage structure of claim 1, wherein the hinge is a barrel-type hinge.

3. The rotatable storage structure of claim 2, wherein the at least one fastener further comprises a bracket to which the hinge is attached, and wherein the bracket is configured to attach to the one of the pair of sides.

4. The rotatable storage structure of claim 3, wherein the at least one fastener comprises two fasteners, one of the two fasteners located toward the top of the housing and another one of the two fasteners located toward the bottom of the housing.

5. The rotatable storage structure of claim 1, wherein the housing includes a plurality of shelves disposed within the interior thereof.

6. The rotatable storage structure of claim 5, wherein the front of the housing is open.

7. A headboard with rotatable storage structure comprising:

a headboard for attachment at a head end of a bed frame, the headboard including:

a first bedpost at a first side of the headboard; and a second bedpost at a second side of the headboard; and a pair of rotatable storage structures comprising of a first rotatable storage structure configured to attach to the first bedpost, and a second rotatable storage structure configured to attach to the second bedpost, the pair of rotatable storage structures each including:

a housing having a top opposite a bottom, a front opposite a rear and a pair of sides all defining an interior for receiving items accessible from the front; and at least one fastener attached to one of the pair of sides, the at least one fastener including a hinge having a cylindrical body comprising a central elongated opening extending from a top of the hinge to a bottom of the hinge and configured to receive one of the first bedpost and the second bedpost therein; and wherein the housing is able to rotate between a first position and a second position via the hinge, and wherein the hinge fully circumscribes the bedpost.

8. The headboard with rotatable storage structure of claim 7, wherein the first position includes a width of the housing being generally parallel to a length of the bed frame, and wherein the second position includes the width of the housing being generally perpendicular to the length of the bed frame.

9. The headboard with rotatable storage structure of claim 8, wherein the hinge is a barrel-type hinge.

10. The headboard with rotatable storage structure of claim 9, wherein the at least one fastener comprises two fasteners, one of the two fasteners located toward the top of the housing and another one of the two fasteners located toward the bottom of the housing.

11. The headboard with rotatable storage structure of claim 7, wherein the housing includes a plurality of shelves disposed within the interior thereof.

12. The headboard with rotatable storage structure of claim 11, wherein the front of the housing is open.

13. A bed with rotatable storage structure comprising:

a bed frame including a mattress frame, at least one support section attached to and extending downwardly from the mattress frame to support the bed frame on a surface, a first bedpost at a first side of a head end of the bed frame and a second bedpost at a second side of the head end of the bed frame; and a pair of rotatable storage structures comprising of a first rotatable storage structure configured to attach to the first bedpost, and a second rotatable storage structure configured to attach to the second bedpost, the pair of rotatable storage structures each including:

a housing having a top opposite a bottom, a front opposite a rear and a pair of sides all defining an interior for receiving items accessible from the front; and at least one fastener attached to one of the pair of sides, the at least one fastener including a hinge having a cylindrical body comprising a central elongated opening extending from a top of the hinge to a bottom of the hinge and configured to receive one of the first bedpost and the second bedpost therein; and wherein the housing is able to rotate between a first position and a second position via the hinge, and wherein the hinge fully circumscribes the bedpost.

14. The bed with rotatable storage structure of claim 13, wherein the at least one support section includes a plurality of support legs.

15. The bed with rotatable storage structure of claim 14, wherein the first position includes a width of the housing being generally parallel to a length of the bed frame, and wherein the second position includes the width of the housing being generally perpendicular to the length of the bed frame.

16. The bed with rotatable storage structure of claim 15, wherein the hinge is a barrel-type hinge.

17. The bed with rotatable storage structure of claim 16, wherein the at least one fastener comprises two fasteners, one of the two fasteners located toward the top of the housing and another one of the two fasteners located toward the bottom of the housing.

18. The bed with rotatable storage structure of claim 13, wherein the housing includes a plurality of shelves disposed within the interior thereof.

19. The bed with rotatable storage structure of claim 18, wherein the front of the housing is open.

* * * * *